United States Patent [19]

D'Amico et al.

[11] 4,212,703

[45] Jul. 15, 1980

[54] PROCESS FOR THE MANUFACTURE OF LAMINATED SHEETS OF CELLULOSIC AND POLYMERIC FIBROUS MATERIALS

[75] Inventors: Fabrizio D'Amico, San Donato Milanese; Giancarlo Serboli, Saronno; Vincenzo Foti, Milan, all of Italy

[73] Assignee: Anic, S.p.A., Italy

[21] Appl. No.: 754,223

[22] Filed: Dec. 27, 1976

Related U.S. Application Data

[63] Continuation of Ser. No. 541,341, Jan. 15, 1975, abandoned.

[30] Foreign Application Priority Data

Jan. 15, 1974 [IT] Italy ..... 19410 A/74

[51] Int. Cl.[2] ..... D21F 11/04

[52] U.S. Cl. ..... 162/129; 162/132; 162/133; 162/146; 162/206

[58] Field of Search ..... 162/125, 129, 132, 146, 162/133, 157 R, 206; 428/511, 513

[56] References Cited

U.S. PATENT DOCUMENTS

| | | | |
|---|---|---|---|
| 2,881,072 | 4/1959 | Clark | 162/104 |
| 3,123,518 | 3/1964 | Bundy | 162/146 |
| 3,511,750 | 5/1970 | Hider | 428/513 |
| 3,669,829 | 6/1972 | Caldo et al. | 162/146 |
| 3,778,341 | 12/1973 | Plummer et al. | 162/125 |

*Primary Examiner*—William F. Smith

*Attorney, Agent, or Firm*—Morgan, Finnegan, Pine, Foley & Lee

[57] ABSTRACT

A laminated structure of sheets of fibrous cellulosic and polymeric materials is prepared upon a multiple plane table cardboard manufacturing machine by forming a sheet of cellulosic fibers from a pulp thereof on at least one of the plane tables of the machine, forming a sheet of polyolefinic fibrids from a pulp thereof on a second plane table of the machine, and forming a cellulosic fiber-polyolefinic fibrid sheet from a pulp thereof on a third plane table of the machine, joining those sheets in superposed position so that the sheet of cellulosic fibers is in the middle, drying the superposed sheets, and then calendering the dry superposed sheets at a temperature not lower than that necessary to melt at least partially the polyolefinic fibrids.

3 Claims, No Drawings

PROCESS FOR THE MANUFACTURE OF LAMINATED SHEETS OF CELLULOSIC AND POLYMERIC FIBROUS MATERIALS

This is a continuation of application Ser. No. 541,341 filed Jan. 15, 1975, abandoned.

The present invention relates to a process for the manufacture of laminated structures constituted by cellulosic and polymeric materials. It is known that the manufacture of laminated materials constituted by the combination of cellulosic materials (paper, cardboard and so on) and polymeric materials involves the use of different apparatuses, namely, those which permit the production of paper and/or cardboard and those upon which the polymeric materials may be spread.

For instance hot spreading of paper or cardboard with polyolefins involves the use of an extruder and of a coupling line constituted essentially by a rolling mill with a coiler and decoiler by means of which the polymer is spread, while paper is produced separately by means of conventional continuous machines.

It has been found and this constitutes the subject of the invention, that it is possible to manufacture laminated structures constituted by cellulosic materials, in particular paper or cardboard, and polymeric materials, in particular polyolefins, by using only the machines used for the manufacture of cardboard.

The process which is the subject of the present invention consists in feeding to a multiple plane table machine for the manfacture of cardboard different compositions so constituted: we feed to one or more of the plane tables a pulp consisting of dispersion of cellulosic fibers, to at least one of the plane tables a pulp consisting of dispersion of polyolefinic synthetic fibrids and to the remaining tables a pulp consisting of a mixture of cellulose fibers and polyolefinic synthetic fibrids.

The sheets (synthetic and cellulosic sheets) which are obtained are superposed before entering the dry end zones and subsequently they are dried in the conventional way in which cardboards are dried. Then the dry sheet constituted by layers of the different papers is subjected to hot calendering at a temperature not lower than that necessary to melt at least partially the layer or the layers constituted by polyolefinic synhtetic fibrids.

The method which is the subject of the present invention makes it possible therefore to obtain with high rates of production (corresponding to those of the process for the manufacture of cardboard) a laminated structure avoiding the necessity of spreading the polymer and manufacturing the cellulosic cardboard separately.

The method which is the subject of the present invention makes it possible furthermore in a very simple way to obtain stratified materials wherein one or more of the layers is (are) constituted by mixed cellulose-polymer materials. This is impossible with conventional spreading. The method according to the invention makes it possible moreover to vary as one desired the type of material to be manufactured simply by modifying one or more of the feeds to the plane tables.

An unrestrictive example of laminated structure which may be manufactured by means of continuous machines for cardboard is the one constituted by a central layer of cellulosic cardboard covered on one side by a sheet constituted by 100% polyolefinic base synthetic fibrids (50 g/m$^2$) and on the other side by a sheet constituted by a mixture of cellulose fibrids and polyolefinic base synthetic fibrids (80 g/cm$^2$).

The composite material, having in this case three layers, is subsequently dried in the dry end zone of the continuous machine in the same way as pure cellulose cardboard is treated.

Subsequently the composite structure is hot calendered at a temperature of 135° C. so as to melt the portion constituted by the sheet at 100% synthetic polyolefinic pulp and obtain a transparent film analogous to the one obtainable by means of a conventional hot spreading.

The final structure is therefore constituted by there layers, the internal one being cardboard and the two external layers being respectively a polyolefinic film and a layer formed by mixed cellulose-polyolefin paper.

A composite structure like the one above described is perfectly suitable for wraping liquid and/or solid food stuffs (milk, fruit juices, butter and so on) since the internal layer of paper or cardboard gives a certain stiffness to the structure, the melted polymeric layer in contact with food gives it an impermeability to liquids and gases and the external layer of mixed cellulose-synthetic pulp paper makes it possible to obtain a white surface having a high degree of opacity and brightness, a remarkable dimensional stability and water repellency according to the content of synthetic pulp and also a good printability.

The remarkable whiteness and opacity of the external layer of the composite structure makes it possible to use, for the internal layer of paper or cardboard, cellulosic materials having a not very high quality and which have been no bleached.

If the layer constituted by paper of 100% synthetic pulp or by a cellulose-synthetic pulp mixture is hot calendered but at a temperature lower than that of melting of the polymer or in any case at such a temperature that the formation of the polyolefinic film does not occur, there is a strengthening of the composite sheet due to the fact that various synthetic fibers become welded to each other at their contact points and a surface very similar to that of a coated paper produced in conventional manner is obtained.

It is obvious that the thermal treatment, especially if directed to a partial surface melting of the sheet, lowers the absorption power of the paper with respect to printing inks with consequent difficulties in the subsequent printing phases.

This can be partly obviated either by using synthetic pulps constituted by fibers containing mineral fillers or by adding, to the mix of synthetic pulp, fillers commonly used in the paper industry; producing in such a way on the sheet surface centers having high absorbing power. The synthetic pulps which may be used in accordance with the present invention are the ones coming from the polymers described in our Italian Patent Application No. 29620 A/73 (filing date: Oct. 2, 1973) having as title "Process for the production of fibrous structures". The synthetic pulps are in any case preferably of polyethylene type.

We have found a simple and economical process which permits to obtain fibrids having very good characteristics with high productivities.

The process according to the invention is based on the fact that a mixture of a least two compounds at different ratios is subjected to a flash for obtaining fibrous structures, said compounds being selected in such a way that they present between themselves either different molecular weights or different structures or different properties so as to be considered the one in comparison with the other as presenting a certain incompatibility (such as mixing difficulties in some field or range of temperature and/or pressure and/or concentration).

This is a surprising feature since for obtaining fibrids the known art suggested the use of surface active agents (i.e. of substance capable to improve the compatibility between polymer and solvent).

Besides being surprising, since it was unforeseeable that incompatible compounds could give products remarkable better than those obtained according to the know art, the process according to the invention permits to obtain a further remarkable advantage since the (incompatible) compound utilized in minor amounts in comparison with the other one enters the final structure of the fibrid and in this way we have a single method for imparting particular properties to the fibrids such as for instance wettability, dyeability, chemical reactivity or (chemical-physical) affinity for other compounds. The process according to the invention consists in preparing a substantially homogeneous phase of a polymeric compound preferably a solution, in adding said substantially homogeneous phase to another substantially homogeneous phase of another (or other) compound (compounds) at some extent incompatible with the first compound, in subjecting the whole to the heating and pressure action necessary to give the energy (thermic and/or mechanical) for carrying out a quick flash (removal of liquid phases from the solid phases) and in collecting the obtained fibrous material.

The substantially homogeneous phase of the first base compound (or compounds) from which one wants to obtain the fibrous structure, can be conveniently obtained by dissolving the selected compound in one or more solvents and/or diluents and use is made for obtaining the highest concentration, also of the effect due to the temperature and pressure.

The second compound (when only a second compound is present) is added in an amount decidedly lower such as for instance lower than 50% by weight of the base compound, and preferably but unrestrictively in a percentage of from 10% to 20%. The concept of "base compounds" or "other compounds" is relative since the two compounds can exchange their function.

Another interesting feature of the invention is the possibility the use artificial natural polymeric compounds (for instance cellulosic materials) and add to them minor amounts of synthetic compounds for obtaining final products having determinate and improved properties. The compounds which can be used according to the invention are the polymers convertible into a liquid homogeneous phase by means of diluents and of temperature and pressure and susceptible to undergo a substantially complet flash. Among the most interesting polymers we can quote polyethylene, polypropylene, olefinic copolymers, polyvinylacetate, polystyrene polyvinylalcohol, compolymers and so on.

An example of mixture can be the one constituted either by a high molecular weight polyethylene and another polyethylene having lower molecular weight (for instance up to products of the wax type) or also a high density polyethylene and a low density polyethylene of equal molecular weight (in this case the difference of structure is exploited).

The mixing types possible in function also of the final products which one wants to produce are known to the technicians.

As to the incompatibility and to the method for its quantization see the article "Polymers compatibility" J. Macromol, Sci, Revs, Macromal. Chem 7(2) 251–314 (1972).

Under a certain point of view use can be made according to the invention of the criteria for the Production of conjugate fibers in a process for the production of fibers by simple flash.

The process according to the invention takes place at temperatures higher than that of the melting point or the softening point or dissolution point and at pressures at least higher than the vapour pressure of the solvent at the flash temperature.

In a preferred embodiment the homogeneous phases are prepared in a first stage at more moderate temperature and pressure conditions and then the mass is subjected to the intensive action of both factors in a second stage and at last to flash and collecting the fibrous material.

Many variants can be brought to the process on the basis of the knowledges of those skilled in the art and the invention comprises also said obvious applications even though they are not specifically mentioned in the present description.

Without limiting the invention we now report the following examples which aim at illustrating the same in a better way.

EXAMPLE 1

An autoclave provided with heating jacket and stirrer was charged with n-heptane and high density polyethylene (MFI=0.5 g/10') so that the polyethylene concentration was 12% by weight with respect to n-heptane.

We heated under stirring up to a temperature of 175° C. corresponding to a vapour pressure of 6.5 kg/cm$^2$ up to a complete homogenization of metted polyethylene and n-heptane.

The solution was fed through a gear pump which raised the pressure from 6.5 kg/cm$^2$ to 30–35 Kg/cm$^2$ to a heat exchanger and discharged through a nozzle of 1 mm diameter and 1 mm thickness.

The solution temperature before expansion was about 195° C.

The obtained product was constituted by a filamentous mass constituted by very thin continuous fibers entangled among them.

EXAMPLE 2

An autoclave provided with heating jacket and stirrer was charged with n-heptane and high density polyethylene.

(MFI=0.5 g/10') so that the concentration of polyethylene in comparison with n-heptane was 12% by weight.

Then a saturated solution at room temperature of polystyrene in toluene was added so that the polystyrene concentration become 10% by weight in comparison with polyethylene (Polystyrene ($\psi$) 25° Toluene=0.36).

The same procedure as that in example 1 was followed and the "solution" was expanded though a nozzle of 1 mm diameter and 1 mm thickness.

The product, morphologically very different from the one described in example 1 was constituted by fibrids or very thin fiber bundles having a length ranging from 1 to 10 mm with an average diameter of about 10 microns. The diameter of the single filaments constituting the bundles could reach also a diameter of about 0.2–0.4 microns.

High density polyethylene fibrids having the same morphological characteristics were obtained by working according to example 1 but lowering the polyethylene concentration in comparison with n-heptane to 5-6% by weight.

EXAMPLE 3

An autoclave provided with a heating jacket and stirrer was charged with n-heptane and high density polyethylene (MFI—2.9 g/10') so that the polyethylene concentration in comparison with n-heptane was 11% by weight. Furthermore low density polyethylene (average molecular 9000) was added so that its concentration resulted 20% in comparison with high density polyethylene.

We heated under stirring up to a temperature of about 175° C. corresponding to a vapour pressure of 6.5 kg/cm$^2$ so completely homogenizing melted polyethylene and n-heptane. The "solution" was then sent through a gear pump which raised the solution pressure from 6.5 kg/cm$^2$ to 30 kg/cm$^2$ to a heat exanger and discharged through a nozzle having 1 mm diameter and 1 mm thickness. The temperature of the solution before expansion was about 185-190° C. The obtained fibrids presented sizes and morphologies very similar to the ones described in example 2.

EXAMPLE 4

An autoclave provided with heating jacket and stirrer was charged with n-heptane and high density polyethylene (MFI=2.9 g/10') so that the polyethylene concentration in comparison with n-heptane was 12% by weight.

A solution of polyvinylacetate (Molecular weight 35,000) in toluene was then added so that the polyvinylacetate concentration was 70% in comparison with polyethylene.

The whole was heated under stirring up to a temperature of 175° C. the corresponding pressure being 6.5 kg/cm$^2$.

The "solution" pressure was raised by means of gear pump up to 32 kg/cm$^2$ and the temperature was brought to 190° C. by means of heat exchanger.

The "solution" was then discharged through a nozzle having 1 mm diameter and 1 mm thickness.

The obtained fibrids resulted in size and morphology very similar to the ones described in examples 2 and 3.

The fibrids produced according to the method of the present invention can be collected directly as dry fibrids on a belt conveyor or sprayed directly in water and removed from the zone close to the nozzle by means of a pump which may be of the type suitable for cellulose pulp or by means of a screw feeder. In said case additives were added to water, generally they being surface active agents which allowed the fibride to be wettable and therefore compatible with water.

For instance a formulation which gave very good results was an aqueous solution containing at least 1% polyvinyl alcohol, at least 1% of carboxymethylcellulose and at least 0.5% of a non ionic surface active agent, for instance ethylene oxide-propylene oxide adduct.

The polyvinyl alcohol used in the precedingly described formulation presented a saponification grade of about 98% and a viscosity at 20° C. (4% of acqueous solution—Hoppler viscosimeter) of about 20 cP.

As to the incompatibility between high density polyethylene and low molecular weight polyethylene see R-A ISAKSEN, S. NEW MAN AND R. J. CLARK J. APP. POLYM. SCI. VOL. 7/515-531 (1963).

By means of the process of the present invention it is possible to produce, use being made of paper technology, any type of composite structure having more than one component.

It is possible to join, as aforesaid, cellulosic and synthetic materials with various combinations in two, three or more layers.

Also hot calendering can range according to the temperature, pressure, speed of the rolls from a melting at the contact points of the polymeric fibers up to the complete melting of the polymeric layer.

The complete melting during calendering of a paper sheet constituted for instance by 100% synthetic pulp (high density polyethylene) makes it possible moreover to produce wrapping films exploiting all the advantages of the paper technology.

The composite products obtained according to the process of the present invention can be advantageously utilized also in particular as papers for electric uses, because of the high dielectric characteristics of the polyolefins.

What we claim is:

1. A process of manufacturing a laminated structure of cellulosic and polyolefinic fibrous materials comprising, forming a sheet of cellulosic fibers by feeding a pulp of said fibers to at least one of the inner tables of a multiple plane table cardboard manufacturing machine, forming a sheet of polyolefinic fibrids by feeding a pulp of said fibrids to an outer table of said machine, forming a composite sheet of cellulosic fibers and polyolefinic fibrids by feeding a pulp of said fibers and fibrids to the other outer table of said machine, joining said sheets in superposed position, drying the superposed sheets, and then hot calendering said dried superposed sheets at a temperature not lower than that necessary to melt at least partially said polyolefinic fibrids.

2. A process as claimed in claim 1, wherein the multiple plane table cardboard manufacturing machine has three tables, feeding the cellulosic fiber pulp to the central table, and feeding the polyolefinic fibrid pulp and the cellulosic fiber-polyolefinic fibrid pulp to the outer and inner tables, respectively, of said machine, so that the sheet of cellulosic fibers is sandwiched between the other sheets in the laminated structure.

3. A process as claimed in claim 1, wherein said polyolefinic fibrids are polyethylene.

* * * * *